US008349531B2

(12) United States Patent
Young et al.

(10) Patent No.: US 8,349,531 B2
(45) **Date of Patent: *Jan. 8, 2013**

(54) COMPOUNDS AND METHODS OF FORMING COMPOUNDS USEFUL AS A TONER

(75) Inventors: Timothy J. Young, Bay City, MI (US); Richard A. Lundgard, Midland, MI (US); Michael J. Johnson, Midland, MI (US); Qichun Wan, Midland, MI (US); Matthew J. Kalinowski, Freeland, MI (US); Mechelle A. Churchfield, Midland, MI (US); Gary M. Strandburg, Mount Pleasant, MI (US)

(73) Assignee: Dow Global Technologies LLC, Midland, MI (US)

( * ) Notice: Subject to any disclaimer, the term of this patent is extended or adjusted under 35 U.S.C. 154(b) by 70 days.

This patent is subject to a terminal disclaimer.

(21) Appl. No.: 12/744,407

(22) PCT Filed: Nov. 26, 2008

(86) PCT No.: PCT/US2008/084856

§ 371 (c)(1),
(2), (4) Date: May 24, 2010

(87) PCT Pub. No.: WO2009/073512

PCT Pub. Date: Jun. 11, 2009

(65) Prior Publication Data

US 2010/0248119 A1 Sep. 30, 2010

Related U.S. Application Data

(60) Provisional application No. 60/991,180, filed on Nov. 29, 2007.

(51) Int. Cl.
*G03G 5/00* (2006.01)

(52) U.S. Cl. ..... 430/137.1; 524/522; 524/543; 430/108.1; 430/108.2; 430/109.1; 430/137.14

(58) Field of Classification Search ..... 430/108.1, 430/108.2, 108.4, 108.6, 109.1, 109.4, 110.1, 430/137.1, 137.14; 524/300, 522, 543
See application file for complete search history.

(56) References Cited

U.S. PATENT DOCUMENTS 2,297,691 A 10/1942 Carlson
(Continued)

FOREIGN PATENT DOCUMENTS

EP 0 170 331 A1 2/1986
(Continued)

OTHER PUBLICATIONS

Report on Patentability for counterpart PCT Patent Application No. PCT/US2008/084856, dated Jun. 1, 2010, 6 pages.

(Continued)

*Primary Examiner* — Stewart Fraser

(57) ABSTRACT

Compounds and methods of forming compounds useful as a toner or toner precursor are disclosed. The compounds may include an aqueous dispersion, the dispersion including: (A) at least one thermoplastic resin; and (B) 0 to 5 weight percent of a stabilizing agent, based on the total weight of (A) and (B). The dispersion may have an average volume diameter particle size from about 0.05 to about 10 microns. A combined amount of the thermoplastic resin and the stabilizing agent may have an acid number of less than 25 mg KOH/g.

18 Claims, 1 Drawing Sheet

U.S. PATENT DOCUMENTS

| | | | | |
|---|---|---|---|---|
| 3,590,000 | A | 6/1971 | Palermiri et al. | |
| 3,645,992 | A | 2/1972 | Elston | |
| 3,910,846 | A | 10/1975 | Azar et al. | |
| 4,076,698 | A | 2/1978 | Anderson et al. | |
| 4,599,392 | A | 7/1986 | McKinney et al. | |
| 4,816,366 | A | 3/1989 | Hyosu et al. | |
| 4,988,781 | A | 1/1991 | McKinney et al. | |
| 5,272,236 | A | 12/1993 | Lai et al. | |
| 5,278,272 | A | 1/1994 | Lai et al. | |
| 5,677,383 | A | 10/1997 | Chum et al. | |
| 5,756,659 | A | 5/1998 | Hughes | |
| 5,843,614 | A | 12/1998 | Shinzo et al. | |
| 5,844,045 | A | 12/1998 | Kolthammer et al. | |
| 5,869,575 | A | 2/1999 | Kolthammer et al. | |
| 5,938,437 | A | 8/1999 | DeVincenzo | |
| 5,974,281 | A | 10/1999 | Fujii et al. | |
| 6,111,023 | A | 8/2000 | Chum et al. | |
| 6,316,549 | B1 | 11/2001 | Chum et al. | |
| 6,395,445 | B1 | 5/2002 | Toth et al. | |
| 6,445,636 | B1 | 9/2002 | Keeth | |
| 6,448,341 | B1 | 9/2002 | Kolthammer et al. | |
| 6,455,636 | B2 | 9/2002 | Sanada | |
| 6,477,348 | B2 | 11/2002 | Miyamoto et al. | |
| 6,512,024 | B1 | 1/2003 | Lundgard et al. | |
| 6,512,025 | B2 | 1/2003 | Choudhery | |
| 6,521,679 | B1 | 2/2003 | Okada et al. | |
| 6,538,070 | B1 | 3/2003 | Cardwell et al. | |
| 6,566,446 | B1 | 5/2003 | Parikh et al. | |
| 6,821,703 | B2 | 11/2004 | Uno et al. | |
| 6,894,090 | B2 | 5/2005 | Shinzo et al. | |
| 7,161,612 | B2 | 1/2007 | Kamimura | |
| 7,166,401 | B2 | 1/2007 | Tanaka et al. | |
| 7,169,525 | B2 | 1/2007 | Sugiura et al. | |
| 7,177,570 | B2 | 2/2007 | Nagame et al. | |
| 7,177,582 | B2 | 2/2007 | Ohta et al. | |
| 7,279,261 | B2 | 10/2007 | Lee et al. | |
| 2003/0232268 | A1 | 12/2003 | Sacripante et al. | |
| 2005/0100809 | A1 | 5/2005 | Fujino et al. | |
| 2005/0271965 | A1 | 12/2005 | Kamiyoshi et al. | |
| 2006/0078485 | A1 | 4/2006 | Thiele et al. | |
| 2006/0223934 | A1 | 10/2006 | Chen et al. | |
| 2007/0141494 | A1 | 6/2007 | Zhou et al. | |
| 2007/0243481 | A1* | 10/2007 | Klier et al. | 430/111.35 |
| 2008/0009586 | A1 | 1/2008 | VanSumeren et al. | |
| 2010/0143837 | A1* | 6/2010 | Klier et al. | 430/114 |

FOREIGN PATENT DOCUMENTS

| | | | |
|---|---|---|---|
| EP | 0 246 729 | A2 | 11/1987 |
| EP | 0 797 122 | A1 | 9/1997 |
| EP | 1 202 122 | A1 | 5/2002 |
| EP | 1 263 844 | A0 | 12/2002 |
| EP | 1 316 578 | A1 | 6/2003 |
| EP | 1 679 552 | A1 | 7/2006 |
| JP | 2002-351140 | | 12/2002 |
| JP | 2007-147699 | | 6/2007 |
| JP | 2007-264577 | | 10/2007 |
| WO | 02/01301 | A1 | 1/2002 |
| WO | 2005/095277 | A1 | 10/2005 |

OTHER PUBLICATIONS

Amendment to Claims for counterpart EP Patent Application No. 08 856 276.4, dated Aug. 24, 2010, 8 pages.

International Search Report from PCT/US2008/084856 dated Mar. 13, 2009 (4 pages).

Written Opinion from PCT/US2008/084856 dated Mar. 13, 2009 (6 pages).

Examiners Report dated Aug. 24, 2011 from counterpart Canadian Application No. 2706726, 2 pages.

Response to Canadian Office Action dated Feb. 24, 2012 for counterpart Canadian Application No. 2706726.

Instructions to Chinese 2nd Official Action dated Aug. 17, 2012; from Chinese counterpart application No. 200880125835.2.

Chinese First Office Action dated Dec. 31, 2011 for counterpart Chinese Application No. 200880125835.2.

Response to First Office Action filed May 14, 2012 for counterpart Chinese Application No. 200880125835.2.

Canadian Examiner's Report dated Apr. 20, 2012 for counterpart Canadian Application No. 2706726.

Chinese 2nd Office Action dated Jun. 6, 2012; from counterpart Chinese Application No. 2008/0125835.2.

Chinese Instructions to 2nd Office Action dated Aug. 17, 2012; from counterpart CN application No. 200880125835.2.

Japanese Office Action dated Sep. 3, 2012; from counterpart JP application No. 2010-536165.

CA Instructions to Office Action dated Oct. 10, 2012; from counterpart CA application No. 2706726.

China Response to Second Office Action dated Aug. 21, 2012; from counterpart CN application No. 200880125835.2.

Chinese 3rd Office Action dated Sep. 13, 2012; from counterpart CN application No. 200880125835.2.

Canadian Examination Response dated Oct. 19, 2012; from CA counterpart application No. 2706726.

Instructions to Japanese Office Action dated Oct. 17, 2012; from JP counterpart Application No. 2010-536165.

Further Japanese Office Action dated Nov. 6, 2012 from Instructions to Office Action dated Oct. 17, 2012; from JP counterpart Application No. 2010-536165.

Instructions dated Nov. 20, 2012 to Further JP Office Action of Nov. 6, 2012; from JP counterpart Application No. 2010-536165.

Further Japanese Office Action dated Nov. 22, 2012 from Instructions to Office Action dated Nov. 20, 2012; from JP counterpart Application No. 2010-536165.

Instructions dated Nov. 27, 2012 to Further JP Office Action of Nov. 22, 2012; from JP counterpart Application No. 2010-536165.

Japanese Response to Office Action dated Nov. 30, 2012; from JP counterpart Application No. 2010-536165.

* cited by examiner

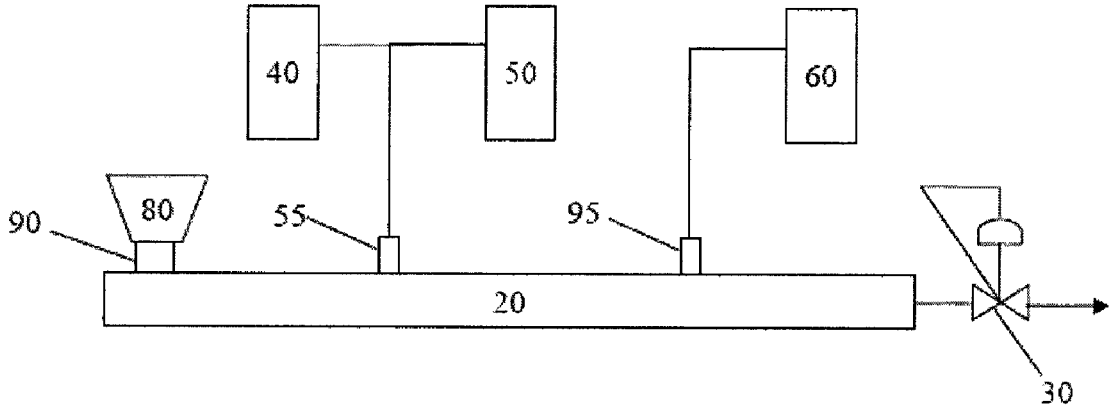
40
50
60
90
80
55
95
20
30

COMPOUNDS AND METHODS OF FORMING COMPOUNDS USEFUL AS A TONER

FIELD OF THE DISCLOSURE

Embodiments disclosed herein relate generally to aqueous dispersions. More specifically, embodiments disclosed herein relate to aqueous dispersion compounds and processes to make aqueous dispersion compounds that are useful as a print toner.

BACKGROUND

In conventional electrophotography processes, a photoreceptive surface is charged with a negative electrical charge, which is then exposed to an image. Because the illuminated sections (the image areas) become more conductive, the charge dissipates in the exposed areas to form a latent image. Negatively charged toner particles spread over the surface adhere to the latent image area to form a toner image. Alternatively, a photosensitive surface is uniformly charged with static electricity, and a latent image may be formed thereon by exposing image area to light. Toner particles are spread over the surface and adhere to the light-formed latent image, which has less of a negative charge than the surrounding surface, thereby forming a toner image and making the latent image visible. If required, the toner image may be transferred onto a transfer material, such as paper. The toner image may then be fixed via fixing means, such as, by heat, pressure, heat and pressure, or solvent vapor to obtain a fixed image. Such process is described, for example, in U.S. Pat. No. 2,297,691.

Typically, toners used in the development and subsequent fixing of toner images in electrophotography have been produced by melt mixing a thermoplastic resin with a coloring agent made of a dye and/or a pigment to produce a resin composition having the coloring agent uniformly dispersed therein. To obtain a toner composition having a particular particle size, the resin composition may be pulverized and/or classified to remove coarse and/or fine particles that may affect the quality of the resulting image. Optimizing the particle size distribution of the toner will allow for a high resolution image. In particular, larger particles can cause blockage while ultra fine dust particles adhere to the print head surface and are too small to have enough charge to be controllable. Thus, as higher resolution images are desired, especially high resolution color images, smaller particle sizes and narrower particle size distributions are needed. Small particles are also desirable because they typically result in improved printing speeds and lower costs per page.

The typical pulverization processes for producing these toners, while able to control the size of the toner particles to produce a high quality toner, often have certain practical limitations. For example, pulverization is a costly and inefficient process for obtaining small particle size, and puts constraints on the type of polymer that may be used, so polymers that are excellent in every other respect may be excluded because they cannot be pulverized. Additionally, a block of a resin composition in which a colorant is dispersed is required to be micro-pulverized by means of an economically usable production device. However, because the resin composition is fragile, particles having a wide range of particle sizes are easily produced when the resin composition is micro-pulverized at high speed. Additionally, such fragile material is liable to be further pulverized in a developing apparatus of a copying machine.

Furthermore, in this pulverization process, it is extremely difficult to uniformly disperse solid fine particles such as the coloring agent in a resin. Therefore, sufficient attention must be paid to the degree of dispersion to avoid potential increased fogging, a reduced image density, and decreased color mixing or transparence of the toner, depending on the degree of dispersion. Additionally, the shape and surface conditions of such toner particles, which may also greatly affect the quality of a toner image, are determined by the cleavage fractures of the resultant particles in the pulverization. Specifically, the pulverization process presents difficulties in controlling the surface conditions of the toner particles, thus when the coloring agent is exposed from the cleavage surface of fine particles of the resin composition, the quality of the developing image may be reduced.

Therefore, to overcome the problems associated with the pulverization process, it has been previously proposed to produce a chemically produced toner through polymerization, which is described, for example, in U.S. Pat. No. 4,816,366. The polymerization process is a process of producing colored polymer particles (i.e., colored resin particles) by mixing a polymerizable monomer with additive components such as a colorant, a charge control agent, and a parting agent to prepare a polymerizable monomer composition and then polymerizing the polymerizable monomer composition by suspension polymerization, emulsion polymerization, dispersion polymerization, or the like. Alternatively, chemically produced toners may also be produced by aggregating preformed polymers with the necessary pigment and additives. In the polymerization processes, the polymer component formed by the polymerization becomes a binder resin to directly form the colored polymer particles.

By eliminating the pulverization step, suspension polymerization or emulsion polymerization can use a softer material for toner particles that need not be as fragile. The integrity of the shape of the toner particles may be better maintained, which also prevents the coloring agent from being exposed on the surface of the toner particles. Furthermore, the classification step may optionally be omitted; thus, significant cost reduction effects such as energy savings, a reduced production time, and an improved step yield may be achieved.

However, toners produced by these polymerization processes are not without inherent limitations. For example, these limitations may include high capital requirements, resulting toners containing residual monomer or contaminated with additives, and limitations on polymer type. Specifically, with respect to the limitations on the types of polymers that may exist, typically, only polymers which can be polymerized in the presence of water may be used, thus excluding broad types of polymers. For example, polyester is a preferred resin for toner due to lower fusing temperature, better gloss, and better pigment wetting compared to styrene acrylate polymers. However, polyester is a condensation polymer which cannot be formed in an aqueous polymerization method. Polyolefin polymers similarly cannot be polymerized in an aqueous environment. With respect to residual monomers, it is difficult to completely react the polymerizable monomer in the polymerization step for forming the binder resin, and thus, an unreacted polymerizable monomer often remains in the resin. As a result, the toner may often contain residual, unreacted monomer. When the toner containing the residual, polymerizable monomer is used in an image forming apparatus, the polymerizable monomer is vaporized out of the toner by heating in a fixing step to worsen a working environment or emit offensive odor. When the content of the polymerizable monomer in the toner is high, the toner also tends to undergo blocking during its storage to aggregate or to cause an offset phenomenon or toner filming on individual members in the image forming apparatus.

Attempts to remove the polymerizable monomer have varied in their success due to the various additives that readily absorb any residual polymerizable monomer in the polymerized toner. The absorbance of the residual monomer by the additives complicates the removal of the residual monomer, as compared to removal of monomer from the binder resin alone. Even when the polymerized toner is fully washed after the polymerization, it is difficult to remove the residual polymerizable monomer adsorbed within the polymerized toner. Attempts to remove the residual polymerizable monomer by heat treatment of the polymerized toner results in aggregation of the polymerized toner.

U.S. Pat. No. 6,894,090 discloses a toner using certain types of resins, but specifically requires an organic solvent. U.S. Pat. No. 7,279,261 discloses an emulsion aggregation toner composition. Other publications discussing various aspects of toners may include U.S. Pat. Nos. 6,512,025, 5,843,614, 6,821,703, 6,521,679, 3,910,846, and 6,395,445, U.S. Patent Application Publication Nos. 20070141494, 20050271965, 20050100809, 20030232268, and 20060223934, EP Publications 170331, 1263844, 1679552, and 0246729, and PCT Application Publication WO 0201301. Toners made in some of these prior art patents and publications may be produced using a high degree of neutralization, sulfonated polyesters, high surfactant levels, and other aspects which may require additional processing steps, and may result in less than optimal toner resins. For example, use of high levels of surfactant or high degree of neutralization may decrease the environmental stability of a toner.

Accordingly, there exists a need for compositions and methods of forming high performance toner that will produce a high quality image without residual side effects.

SUMMARY OF THE DISCLOSURE

In one aspect, embodiments disclosed herein relate to a compound including: an aqueous dispersion, the dispersion including water and: (A) at least one thermoplastic resin; and (B) 0 to 5 weight percent of a stabilizing agent, based on the total weight of (A) and (B); (C) at least one of an internal additive and an external additive; and (D) a neutralizing agent, wherein the neutralizing agent is present in an amount sufficient to neutralize less than 90% on a molar basis of any acid groups in components (A) and (B); wherein the dispersion comprises particles having an average volume diameter particle size from about 0.05 to about 10 microns; and wherein a combined amount of the thermoplastic resin and the stabilizing agent has an acid number of less than 25 milligrams potassium hydroxide per gram of the combined amount (mg KOH/g).

In another aspect, embodiments disclosed herein relate to toners formed from a compound including: an aqueous dispersion, the dispersion including water and: (A) at least one thermoplastic resin; and (B) 0 to 5 weight percent of a stabilizing agent, based on the total weight of (A) and (B); (C) at least one of an internal additive and an external additive; and (D) a neutralizing agent, wherein the neutralizing agent is present in an amount sufficient to neutralize less than 90% on a molar basis of any acid groups in components (A) and (B); wherein the dispersion comprises particles having an average volume diameter particle size from about 0.05 to about 10 microns; and wherein a combined amount of the thermoplastic resin and the stabilizing agent has an acid number of less than 25 mg KOH/g. In another aspect, embodiments disclosed herein relate to cartridges or process cartridges containing such toner compounds.

In another aspect, embodiments disclosed herein relate to methods for forming a toner, the method including: forming a compound, the compound including: an aqueous dispersion, the aqueous dispersion including water and: (A) a thermoplastic resin; and (B) 0 to 5 weight percent of a stabilizing agent, based on the total weight of (A) and (B); wherein the aqueous dispersion comprises particles having an average volume diameter particle size from about 0.05 to about 2 microns; and wherein a combined amount of the thermoplastic resin and the stabilizing agent has an acid number of less than 25 mg KOH/g; and forming toner particles using at least a portion of the compound.

In another aspect, embodiments disclosed herein relate to methods for forming a toner, the method including: forming a compound, the compound including: an aqueous dispersion, the aqueous dispersion including water and: (A) a thermoplastic resin; and (B) 0 to 5 weight percent of a stabilizing agent, based on the total weight of (A) and (B); (C) at least one selected from the group consisting of an internal additive and an external additive, and (D) a neutralizing agent, wherein the neutralizing agent is present in an amount sufficient to neutralize less than 90% on a molar basis of any acid groups in components (A) and (B); wherein the aqueous dispersion comprises particles having an average volume diameter particle size from about 2 to about 10 microns; and wherein a combined amount of the thermoplastic resin and the stabilizing agent has an acid number of less than 25 mg KOH/g; and forming toner particles using at least a portion of the compound.

Other aspects and advantages will be apparent from the following description and the appended claims.

BRIEF DESCRIPTION OF DRAWINGS

FIG. 1 is a simplified schematic of an extruder that may be used in formulating aqueous dispersions in accordance with embodiments of the present disclosure.

DETAILED DESCRIPTION

In one aspect, embodiments disclosed herein relate generally to aqueous dispersions. Aqueous dispersion, as used herein, refers to a thermoplastic resin (plus optional additives) as a discontinuous phase dispersed in a continuous phase that is predominantly water. More specifically, embodiments disclosed herein relate to aqueous dispersion compounds and processes to make aqueous dispersion compounds that are useful as a print toner.

Embodiments of the present invention relate to aqueous dispersions and compounds made from aqueous dispersions that are useful as toner compositions. Aqueous dispersions used in embodiments of the present invention comprise water, (A) at least one thermoplastic resin, and (B) a stabilizing agent. These components used in the aqueous dispersion compound are discussed in more detail below.

Such aqueous dispersions may be used to form different particle size compositions, and may include at least one internal additive or external additive. For example, a small particle size toner composition having aqueous dispersion particles ranging from 0.05 to 2 microns in size may be aggregated to form a toner composition having particles ranging in size from 2 to 20 microns. Alternatively, a toner composition of particles ranging in size from 2 to 20 microns may be formed directly without the need for aggregation.

Selected embodiments used herein involve a substantially organic solvent-free process. Substantially solvent-free as used herein refers to the substantial absence of additional organic solvents, but is not intended to exclude amounts of solvent that may be residually present in various components used in the manufacture of a toner composition.

Thermoplastic Resin

The thermoplastic resin (A) included in embodiments of the aqueous dispersion of the present invention is a resin that is not readily dispersible in water by itself. The term "resin," as used herein, should be construed to include synthetic polymers or chemically modified natural resins such as, but not limited to, thermoplastic materials such as polyvinyl chloride, polystyrene, polyesters, styrene acrylates, polyurethanes, and polyethylene and thermosetting materials such as polyesters, epoxies, polyurethanes, and silicones that are used with fillers, stabilizers, pigments, and other components to form plastics.

The term resin as used herein also includes elastomers and is understood to include blends of olefin polymers. In some embodiments, the thermoplastic resin is a semicrystalline resin. The term "semi-crystalline" is intended to identify those resins that possess at least one endotherm when subjected to standard differential scanning calorimetry (DSC) evaluation. Some semi-crystalline polymers exhibit a DSC endotherm that exhibits a relatively gentle slope as the scanning temperature is increased past the final endotherm maximum. This reflects a polymer of broad melting range rather than a polymer having what is generally considered to be a sharp melting point. Some thermoplastic resins useful in the aqueous dispersions of the invention have a single melting point while other polymers have more than one melting point.

In some thermoplastic resins, one or more of the melting points may be sharp such that all or a portion of the polymer melts over a fairly narrow temperature range, such as a few degrees centigrade. In other embodiments, the thermoplastic resins may exhibit broad melting characteristics over a range of about 20° C. In yet other embodiments, the thermoplastic resins may exhibit broad melting characteristics over a range of greater than 50° C.

Examples of the thermoplastic resin (A) that may be used in the present invention include homopolymers and copolymers (including elastomers) of an alpha-olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene, as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene, as typically represented by ethylene-butadiene copolymer and ethylene-ethylidene norbornene copolymer; and polyolefins (including elastomers) such as copolymers of two or more alpha-olefins with a conjugated or non-conjugated diene, as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymer, ethylene-vinyl alcohol copolymer, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, α-methylstyrene-styrene copolymer, styrene vinyl alcohol, styrene acrylates such as styrene methylacrylate, styrene butyl acrylate, styrene butyl methacrylate, and styrene butadienes and crosslinked styrene polymers; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like; and glassy hydrocarbon-based resins, including poly-dicyclopentadiene polymers and related polymers (copolymers, terpolymers); saturated mono-olefins such as vinyl acetate, vinyl propionate and vinyl butyrate and the like; vinyl esters such as esters of monocarboxylic acids, including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof; resins produced by ring opening metathesis and cross metathesis polymerization and the like. These resins may be used either alone or in combinations of two or more. Examples of specific thermoplastic toner resins include styrene butadiene copolymers with a styrene content of from about 70 to about 95 weight percent.

Thermoplastic resins may include polymers containing at least one ester bond. For example, polyester polyols may be prepared via a conventional esterification process using a molar excess of an aliphatic diol or glycol with relation to an alkanedioic acid. Illustrative of the glycols that can be employed to prepare the polyesters are ethylene glycol, diethylene glycol, propylene glycol, dipropylene glycol, 1,3-propanediol, 1,4-butanediol and other butanediols, 1,5-pentanediol and other pentane diols, hexanediols, decanediols, and dodecanediols. In some embodiments, the aliphatic glycol may contain from 2 to about 8 carbon atoms. Illustrative of the dioic acids that may be used to prepare the polyesters are maleic acid, malonic acid, succinic acid, glutaric acid, adipic acid, 2-methyl-1,6-hexanoic acid, pimelic acid, suberic acid, and dodecanedioic acids. In some embodiments, the alkanedioic acids may contain from 4 to 12 carbon atoms. Illustrative of the polyester polyols are poly(hexanediol adipate), poly(butylene glycol adipate), poly(ethylene glycol adipate), poly(diethylene glycol adipate), poly(hexanediol oxalate), and poly(ethylene glycol sebecate.

As another example, polyester resins obtained by condensation of a dicarboxylic acid components (these dicarboxylic acid components may be substituted by a sulfonic acid group, a carboxyl group, and the like) and alcoholic components (these alcoholic components may be substituted by the hydroxyl group, and the like), polyacrylic acid ester resins or polymethacrylic acid ester resins such as polymethylmethacrylate, polybutylmethacrylate, polymethylacrylate, polybutylacrylate, and the like; polycarbonate resin, polyvinyl acetate resin, styrene acrylate resin, styrene-methacrylic acid ester copolymer resin, vinyltoluene acrylate resin, and the like.

Thermoplastic resins may include homopolymers and copolymers of styrene and derivatives thereof such as polystyrene, poly-p-chlorostyrene, polyvinyltoluene, styrene-p-chlorostyrene copolymer and styrene vinyltoluene copolymer, copolymers of styrene and acrylates such as styrene methylacrylate copolymer, styrene ethylacrylate copolymer, and styrene-n-butyl acrylate copolymer; copolymers of styrene and methacrylate such as styrene-methylmethacrylate copolymer, styrene-ethylmethacrylate copolymer, and styrene-n-butylmethacrylate copolymer; polynary copolymers of styrene, acrylate and methacrylate; as well as styrenic copolymers such as copolymers of styrene and other vinylic monomer, such as styrene-acrylonitrile copolymer, styrene-vinylmethyl ether copolymer, styrene-butadiene copolymer, styrene-vinyl methyl ketone copolymer, styrene-acrylonitrile-indene copolymer and styrene-maleate copolymer; polymethyl methacrylate, polybutyl methacrylate, polyvinyl acetate, polyester, polyamide, epoxy resin, polyvinyl butyral, polyacrylic acid, phenolic resin, aliphatic or cycloaliphatic hydrocarbon resin, petroleum resin and chlorinated paraffin, which may be used alone or may be used in an appropriate combination thereof.

Thermoplastic resins may include suitable non-conjugated diene monomers such as straight chain, branched chain or cyclic hydrocarbon diene having from 6 to 15 carbon atoms. Examples of suitable non-conjugated dienes include, but are not limited to, straight chain acyclic dienes, such as 1,4-hexadiene, 1,6-octadiene, 1,7-octadiene, 1,9-decadiene, branched chain acyclic dienes, such as 5-methyl-1,4-hexadiene; 3,7-dimethyl-1,6-octadiene; 3,7-dimethyl-1,7-octadiene and mixed isomers of dihydromyricene and dihydroocinene, single ring alicyclic dienes, such as 1,3-cyclopentadiene; 1,4-cyclohexadiene; 1,5-cyclooctadiene and 1,5-cyclododecadiene, and multi-ring alicyclic fused and bridged ring dienes, such as tetrahydroindene, methyl tetrahydroindene, dicyclopentadiene, bicyclo-(2,2,1)-hepta-2,5-diene; alkenyl, alkylidene, cycloalkenyl and cycloalkylidene norbornenes, such as 5-methylene-2-norbornene (MNB); 5-propenyl-2-norbornene, 5-isopropylidene-2-norbornene, 5-(4-cyclopentenyl)-2-norbornene, 5-cyclohexylidene-2-norbornene, 5-vinyl-2-norbornene, and norbornadiene. Of the dienes typically used to prepare EPDMs, the particularly preferred dienes are 1,4-hexadiene (HD), 5-ethylidene-2-norbornene (ENB), 5-vinylidene-2-norbornene (VNB), 5-methylene-2-norbornene (MNB), and dicyclopentadiene (DCPD).

One class of desirable thermoplastic resins that may be used in accordance with embodiments disclosed herein includes elastomeric interpolymers of ethylene, a $C_3$-$C_{20}$ α-olefin, especially propylene, and optionally one or more diene monomers. Preferred α-olefins for use in this embodiment are designated by the formula $CH_2{=}CHR^*$, where R* is a linear or branched alkyl group of from 1 to 12 carbon atoms. Examples of suitable α-olefins include, but are not limited to, propylene, isobutylene, 1-butene, 1-pentene, 1-hexene, 4-methyl-1-pentene, and 1-octene. The propylene-based polymers are generally referred to in the art as EP or EPDM polymers. Suitable dienes for use in preparing such polymers, especially multi-block EPDM type polymers, include conjugated or non-conjugated, straight or branched chain-, cyclic- or polycyclic- dienes comprising from 4 to 20 carbon atoms. Dienes may include 1,4-pentadiene, 1,4-hexadiene, 5-ethylidene-2-norbornene, dicyclopentadiene, cyclohexadiene, and 5-butylidene-2-norbornene.

As one suitable type of thermoplastic resin, the esterification products of a di- or poly-carboxylic acid and a diol comprising a diphenol may be used. These resins are illustrated in U.S. Pat. No. 3,590,000, which is incorporated herein by reference. Other specific examples of toner resins include styrene/methacrylate copolymers, and styrene/butadiene copolymers; suspension polymerized styrene butadienes; polyester resins obtained from the reaction of bisphenol A and propylene oxide followed by the reaction of the resulting product with fumaric acid; and branched polyester resins resulting from the reaction of dimethylterephthalate, 1,3-butanediol, 1,2-propanediol, and pentaerythritol, styrene acrylates, and mixtures thereof.

Further, specific embodiments of the present invention employ ethylene-based polymers, propylene-based polymers, propylene-ethylene copolymers, and styrenic copolymers as one component of a composition. Other embodiments of the present invention use polyester resins, including those containing aliphatic diols such as UNOXOL (a mixture of cis and trans 1,3- and 1,4-cyclohexanedimethanol) available from The Dow Chemical Company (Midland, Mich.).

Polyesters useful in embodiments disclosed herein may not require functionalization. For example, toner compositions disclosed herein do not require the use of sulfonated polyesters. Additionally, toner compositions disclosed herein do not require the use of branched polyester resins or crystalline polyester resins. Functionalized, branched, or crystalline polyesters may be used, but are not required for use in toner compositions disclosed herein, whereas they may be required in various prior art toners.

In selected embodiments, one component is formed from ethylene-alpha olefin copolymers or propylene-alpha olefin copolymers. In particular, in select embodiments, the thermoplastic resin comprises one or more non-polar polyolefins.

In specific embodiments, polyolefins such as polypropylene, polyethylene, copolymers thereof, and blends thereof, as well as ethylene-propylene-diene terpolymers, may be used. In some embodiments, preferred olefinic polymers include homogeneous polymers, as described in U.S. Pat. No. 3,645,992 issued to Elston; high density polyethylene (HDPE), as described in U.S. Pat. No. 4,076,698 issued to Anderson; heterogeneously branched linear low density polyethylene (LLDPE); heterogeneously branched ultra low linear density polyethylene (ULDPE); homogeneously branched, linear ethylene/alpha-olefin copolymers; homogeneously branched, substantially linear ethylene/alpha-olefin polymers, which can be prepared, for example, by processes disclosed in U.S. Pat. Nos. 5,272,236 and 5,278,272, the disclosures of which are incorporated herein by reference; and high pressure, free radical polymerized ethylene polymers and copolymers such as low density polyethylene (LDPE) or ethylene vinyl acetate polymers (EVA).

Polymer compositions, and blends thereof, described in U.S. Pat. Nos. 6,566,446, 6,538,070, 6,448,341, 6,316,549, 6,111,023, 5,869,575, 5,844,045, or 5,677,383, each of which is incorporated herein by reference in its entirety, may also be suitable in some embodiments. In some embodiments, the blends may include two different Ziegler-Natta polymers. In other embodiments, the blends may include blends of a Ziegler-Natta polymer and a metallocene polymer. In still other embodiments, the thermoplastic resin used herein may be a blend of two different metallocene polymers. In other embodiments, single site catalyst polymers may be used.

In other particular embodiments, the thermoplastic resin may be ethylene vinyl acetate (EVA) based polymers. In other embodiments, the base polymer may be ethylene-methyl acrylate (EMA) based polymers. In other particular embodiments, the ethylene-alpha olefin copolymer may be ethylene-butene, ethylene-hexene, or ethylene-octene copolymers or interpolymers. In other particular embodiments, the propylene-alpha olefin copolymer may be a propylene-ethylene or a propylene-ethylene-butene copolymer or interpolymer.

Embodiments disclosed herein may also include a polymeric component that may include at least one multi-block olefin interpolymer. Suitable multi-block olefin interpolymers may include those described in, for example, U.S. Provisional Patent Application No. 60/818,911, incorporated herein by reference. The term "multi-block copolymer" or "multi-block interpolymer" refers to a polymer comprising two or more chemically distinct regions or segments (referred to as "blocks") preferably joined in a linear manner, that is, a polymer comprising chemically differentiated units which are joined end-to-end with respect to polymerized ethylenic functionality, rather than in pendent or grafted fashion. In certain embodiments, the blocks differ in the amount or type of comonomer incorporated therein, the density, the amount of crystallinity, the crystallite size attributable to a polymer of such composition, the type or degree of tacticity (isotactic or syndiotactic), regio-regularity or regio-irregularity, the amount of branching, including long chain branching or hyper-branching, the homogeneity, or any other chemical or physical property.

Other olefin interpolymers include polymers comprising monovinylidene aromatic monomers including styrene, o-methyl styrene, p-methyl styrene, t-butylstyrene, and the like. In particular, interpolymers comprising ethylene and styrene may be used. In other embodiments, copolymers comprising ethylene, styrene and a $C_3$-$C_{20}$ $\alpha$-olefin, optionally comprising a $C_4$-$C_{20}$ diene, may be used.

In other embodiments, the thermoplastic resin is a glassy polymer and may have a glass transition temperature of less than 130° C.; less than 110° C. in other embodiments. In preferred embodiments, the glass transition temperature may be from 20 to 100° C. In more preferred embodiments, the glass transition temperature may be from 50 to 75° C.

In certain embodiments, the thermoplastic resin may have a weight average molecular weight greater than 1,000 g/mole. In other embodiments, the weight average molecular weight may be from 2,000 to 250,000 g/mole; in yet other embodiments, from 5,000 to 150,000 g/mole.

The one or more thermoplastic resins may be contained within the aqueous dispersion in an amount from about 1% by weight to about 96% by weight. For instance, during particle formation, the thermoplastic resin may be present in the aqueous dispersion in an amount from about 40% by weight to about 95% by weight, such as from about 45% to 95% by weight in some embodiments, and from about 60% to about 95% by weight in yet other embodiments. After particle formation, the aqueous dispersion may be further diluted to aid in handling.

In one or more embodiments of the present invention, one or more resins selected from the following may be used in the aqueous dispersions disclosed herein to form a toner composition. Suitable resins include SAA100, SAA101, and SAA104, which are commercially available from Lyondell Chemical and comprise styrenic/allyl alcohol copolymers having 60-80% styrene, weight average molecular weight from 3,000 to 8,000, number average molecular weight from 1,500 to 3,200, and glass transition temperature from 57 to 78° C.; the DIANAL® FB series (styrenic-acrylic copolymers) and DIACRON® series (polyester resins), and acrylic resins including ER-535, ER-561, ER-502, FC-1935, ER-508, FC-1565, FC-316, ER-590, FC-023, FC-433, SE-5437, SE-5102, SE-5377, SE-5649, SE-5466, SE-5482, HR-169, 124, HR-1127, HR-116, HR-113, HR-148, HR-131, HR-470, HR-634, HR-606, HR-607, LR-1065, 574, 143, 396, 637, 162, 469, 216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117, which are commercially available from Mitsubishi Rayon Co Ltd. and its subsidiary Dianal America, Inc.; Himer ST95 and ST120, which are acrylic copolymers commercially available from Sanyo Chemical Industries, Ltd.; FM601, which is an acrylic resin commercially available from Mitsui Chemicals; HRJ11441, which is a branched partially crosslinked polyester resin commercially available from Schenectady Int'l; TUFTONE® NE-382, TUFTONE® U-5, ATR-2009, and ATR-2010, which are polyester resins commercially available from Kao Specialties Americas, LLC; S103C and S111, which are styrene acrylonitrile terpolymers commercially available from Zeon Chemicals, LP; LUPRETON® resins, which polyester resins with color concentrates commercially available from BASF Corp.; FINE-TONE® T382ESHHMW, T382ES, T6694, TCX 100, TCX700, TPL400, TRM70, which are polyester resins commercially available from Reichhold Chemicals, Inc.; TOPAS® TM, TOPAS® TB, and TOPAS® 8007, which are cyclic olefin copolymers commercially available from Ticona GMBH Corp.; S-LEC resins, including SE-0020, SE-0030, SE-0040, SE-0070, SE-0080, SE-0090, SE-0100, SE-1010, and SE-1035, which are styrene-acrylic copolymers commercially available from Sekisui Chemical Co., Ltd.; BAILON 290, BAILON 200, BAILON 300, BAILON 103, BAILON GK-140, and BAILON GK-130 which are commercially available from Toyobo Co., Ltd; Eritel UE3500, UE3210, and XA-8153, which are commercially available from Unitika Ltd.; and Polyester TP-220 and R-188, which are commercially available from The Nippon Synthetic Chemical Industry Co., Ltd.

In some embodiments, thermoplastic resins useful in embodiments disclosed herein, such as a self-stabilizing resin, may have an acid number of 50 mg KOH/g or less, such that with the addition of a neutralizing agent an aqueous resin dispersion can be prepared. In other embodiments, the thermoplastic resin may have an acid number of 25 mg KOH/g or less; 20 mg KOH/g or less in other embodiments; and 15 mg KOH/g or less in yet other embodiments. In other various embodiments, thermoplastic resins useful in embodiments disclosed herein may have an acid number ranging from a lower limit of 0, 1, 2, 3, 4, 5, 6, 7, 8, 9, 10, 11, 12, 13, or 15 mg KOH/g to an upper limit of 10, 11, 12, 13, 14, 15, 16, 17, 18, 19, 20, 21, 22, 23, 24, 25 or 50 mg KOH/g, where the range may be from any lower limit to any upper limit. Acid number may be determined, for example, by titration with a solution of potassium hydroxide of a known concentration or other methods as known in the art.

In some embodiments, blends of any of the above-described polymers may be used in the aqueous dispersions disclosed herein. For example, blends of various polymers may be used to result in desired toner properties, such as hot and cold offset resistance, fusing temperature, melt flow, additive compatibility, and triboelectric properties, among others.

Polymer blends used in some embodiments disclosed herein may include blends of various molecular weight polymers. For example, a blend of high and low molecular weight polymers may result in a desired melt flow or other properties as discussed above. Toner compositions disclosed herein, for example, may be formed using two or more polyesters having different molecular weights.

Polymer blends used in other embodiments disclosed herein may include blends of polymers having differing acid number. For example, a self-stabilizing resin, as described above, may be used with one or more neutral polymers. In other embodiments, a self-stabilizing resin may be used in conjunction with one or more resins having a higher or lower acid number, which may provide the ability to tailor the charge susceptibility of the final toner particle. Any resin component of acid value up to 50 can be used in any amount as long as the combined resin blend acid value is 25 or less. For example, a polyester resin having an acid number of 30 may be used in combination with a polyester resin having an acid number of 5.

Those having ordinary skill in the art will recognize that the above list is a non-comprehensive listing of suitable polymers. It will be appreciated that the scope of the present invention is restricted by the claims only.

Stabilizing Agent

Embodiments of the present invention use a stabilizing agent to promote the formation of a stable aqueous dispersion or emulsion. In selected embodiments, the stabilizing agent may be a surfactant, a polymer (different from the thermoplastic resin or resin blends detailed above), or mixtures thereof. In other embodiments, the thermoplastic resin is a self-stabilizer, so that an additional exogenous stabilizing agent may not be necessary. In addition, stabilizing agents may be used alone or in a combination of two or more.

In certain embodiments, the stabilizing agent may be a polar polymer, having a polar group as either a comonomer or grafted monomer. In preferred embodiments, the stabilizing agent may include one or more polar polyolefins, having a polar group as either a comonomer or grafted monomer. Typical polymers include ethylene-acrylic acid (EAA) and ethylene-methacrylic acid copolymers, such as those available under the trademarks PRIMACOR™ (trademark of The Dow Chemical Company), NUCREL™ (trademark of E.I. DuPont de Nemours), and ESCOR™ (trademark of ExxonMobil) and described in U.S. Pat. Nos. 4,599,392, 4,988,781, and 5,938,437, each of which is incorporated herein by reference in its entirety. Other suitable polymers include ethylene-ethyl acrylate (EEA) copolymer, ethylene-methyl methacrylate (EMMA), and ethylene-butyl acrylate (EBA). Other ethylene-carboxylic acid copolymers may also be used. Those having ordinary skill in the art will recognize that a number of other useful polymers may also be used.

Other surfactants that may be used include long chain fatty acids or fatty acid salts having from 12 to 60 carbon atoms. In other embodiments, the long chain fatty acid or fatty acid salt may have from 12 to 40 carbon atoms.

If the polar group of the polymeric stabilizing agent or surfactant is acidic or basic in nature, the polymer or surfactant may be partially or fully neutralized with a neutralizing agent to form the corresponding salt. A suitable polymeric stabilizing agent or surfactant may have any acid number greater than 50. In other embodiments, the combined amount of thermoplastic resin and stabilizing agent used, if any, may have an acid number of less than 25. In other embodiments, the combined amount of thermoplastic resin and stabilizing agent used may have an acid number of 20 or less; 15 or less in yet other embodiments. In other various embodiments, the combined amount of thermoplastic resin and stabilizing agent used may have an acid number ranging from a lower limit of 0, 1, 2, 3, 4, 5, 6, 7, 8, 9, 10, 11, 12, 13, or 15 to an upper limit of 10, 11, 12, 13, 14, 15, 16, 17, 18, 19, 20, 21, 22, 23, 24, or 25, where the range may be from any lower limit to any upper limit.

Additional surfactants that may be useful in the practice of the present invention include cationic surfactants, anionic surfactants, non-ionic surfactants, or combinations thereof. Examples of anionic surfactants include sulfonates, carboxylates, and phosphates. Examples of cationic surfactants include quaternary amines. Examples of non-ionic surfactants include block copolymers containing ethylene oxide and silicone surfactants.

Various commercially available surfactants may be used in embodiments disclosed herein, including: OP-100 (a sodium stearate), OPK-1000 (a potassium stearate), and OPK-181 (a potassium oleate), each available from RTD Hallstar; UNICID 350, available from Baker Petrolite; DISPONIL FES 77-IS and DISPONIL TA-430, each available from Cognis; RHODAPEX CO-436, SOPROPHOR 4D384, 3D-33, and 796/P, RHODACAL BX-78 and LDS-22, RHODAFAC RE-610, and RM-710, and SUPRAGIL MNS/90, each available from Rhodia; and TRITON QS-15, TRITON W-30, DOWFAX 2A1, DOWFAX 3B2, DOWFAX 8390, DOWFAX C6L, TRITON X-200, TRITON XN-45S, TRITON H-55, TRITON GR-5M, TRITON BG-10, and TRITON CG-110, each available from The Dow Chemical Company, Midland, Mich.

In particular embodiments, the stabilizing agent may be used in an amount ranging from zero to about 50% by weight based on the total weight of the stabilizing agent and thermoplastic resin (or thermoplastic resin mixture) used. In other embodiments, the stabilizing agent may be used in an amount from zero up to about 25 weight percent, based on the total weight of the stabilizing agent and the thermoplastic resin; from zero to about 20 weight percent in other embodiments; from zero to about 10 weight percent in other embodiments; from zero to about 5 weight percent in other embodiments; and from zero to about 3 weight percent in yet other embodiments. In some embodiments, the aqueous dispersions and toners described herein may be formed without an added surfactant.

Neutralizing Agent

Embodiments of the present invention use a neutralizing agent to promote the formation of a stable aqueous dispersion or emulsion. If the polar group of the polymeric stabilizing agent, surfactant, or self-stabilizing polymer is acidic or basic in nature, they may be partially or fully neutralized with a neutralizing agent to form the corresponding salt. The salts may be alkali metal or ammonium salts of the fatty acid, prepared by neutralization of the acid with the corresponding base, e.g., NaOH, KOH, and $NH_4OH$. These salts may be formed in situ in the aqueous dispersion formation step, as described more fully below. In certain embodiments, neutralization may be from 10 to 200% on a molar basis of the resin plus stabilizer; from 25 to 200% on a molar basis in other embodiments; from 20 to 110% on a molar basis in other embodiments, from 15 to 90% on a molar basis in other embodiments; less than 90% on a molar basis in other embodiments; and from 50 to 110% on a molar basis in yet other embodiments. For example, for EAA, the neutralizing agent is a base, such as ammonium hydroxide or potassium hydroxide. Other neutralizing agents can include amines or lithium hydroxide, for example. In addition, neutralizing agents may be used alone or in a combination of two or more. Those having ordinary skill in the art will appreciate that the selection of an appropriate neutralizing agent depends on the specific composition formulated, and that such a choice is within the knowledge of those of ordinary skill in the art.

Amines useful in embodiments disclosed herein may include monoethanolamine, diethanolamine, triethanolamine, AMP-95 and TRIS AMINO (each available from Angus), NEUTROL TE (available from BASF), as well as triisopropanolamine, diisopropanolamine, and N,N-dimethylethanolamine (each available from The Dow Chemical Company, Midland, Mich.). Other useful amines may include ammonia, monomethylamine, dimethylamine, trimethylamine, monoethylamine, diethylamine, triethylamine, mono-n-propylamine, dimethyl-n propylamine, N-methanol amine, N-aminoethylethanolamine, N-methyldiethanolamine, monoisopropanolamine, N,N-dimethyl propanolamine, 2-amino-2-methyl-1-propanol, tris(hydroxymethyl)-aminomethane, N,N,N'N'-tetrakis(2-hydroxylpropyl) ethylenediamine. In some embodiments, mixtures of amines or mixtures of amines and other neutralizing agents may be used.

Internal Additives

Wax

Optionally, a wax may also be included in the toner composition. When included, the wax may be present in an amount of from, for example, about 1 weight percent to about 25 weight percent, or from about 5 weight percent to about 20 weight percent, of the toner particles.

Waxes that may be used include waxes with, for example, a weight average molecular weight of from about 100 to about 20,000, in other embodiments from about 500 to about 10,000. Waxes that may be used include, for example, polyolefins such as polyethylene, polypropylene, and polybutene waxes such as those commercially available from Allied Chemical and Petrolite Corporation, for example POLYWAX polyethylene waxes from Baker Petrolite, wax emulsions available from Michaelman, Inc. and the Daniels Products Company, EPOLENE N-15, commercially available from Eastman Chemical Products, Inc., and VISCOL 550-P, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550, SUPERSLIP 6530, available from Micro Powder Inc., fluorinated waxes, for example POLYFLUO 190, POLYFLUO 200, POLYSILK 19, POLYSILK 14, available from Micro Powder Inc., mixed fluorinated, amide waxes, for example MICROSPERSION 19, also available from Micro Powder Inc., imides, esters, quaternary amines, carboxylic acids or acrylic polymer emulsion, for example JONCRYL 74, 89, 130, 537, and 538, all available from SC Johnson Wax, and chlorinated polypropylenes and polyethylenes available from Allied Chemical and Petrolite Corporation and SC Johnson wax. Mixtures of waxes may also be used. Waxes may be included as, for example, fuser roll release agents.

Colorant

Embodiments of the present invention may employ a colorant as part of the composition. A variety of colors may be used. Typically, colors such as yellow, magenta, and cyan may be used. As a black coloring agent, carbon black, a magnetic material, and a coloring agent toned to black using the yellow/magenta/cyan coloring agents shown below may be used.

As a yellow coloring agent, compounds typified by a condensed azo compound, an isoindolynone compound, an anthraquinone compound, an azometal complex methine compound, and an allylamide compound as pigments may be used. Specifically, C.I. pigment yellows 3, 7, 10, 12 to 15, 17, 23, 24, 60, 62, 74, 75, 83, 93 to 95, 99, 100, 101, 104, 108 to 111, 117, 123, 128, 129, 138, 139, 147, 148, 150, 166, 168 to 177, 179, 180, 181, 183, 185, 191:1, 191, 192, 193, and 199 may be suitable for use as a yellow coloring agent. Examples of dyes include C.I. solvent yellows 33, 56, 79, 82, 93, 112, 162, and 163, and C.I. disperse yellows 42, 64, 201, and 211.

As a magenta coloring agent, a condensed azo compound, a diketopyrrolopyrrole compound, anthraquinone, a quinacridone compound, a base dye lake compound, a naphthol compound, a benzimidazolone compound, a thioindigo compound, and a perylene compound may be used. Specifically, C.I. pigment reds 2, 3, 5 to 7, 23, 48:2, 48:3, 48:4, 57:1, 81:1, 122, 146, 166, 169, 177, 184, 185, 202, 206, 220, 221, and 254, and C.I. pigment violet 19 may be suitable for use as a magenta coloring agent.

As a cyan coloring agent, a copper phthalocyanine compound and its derivative, an anthraquinone compound, a base dye lake compound, and the like may be used. Specifically, C.I. pigment blues 1, 7, 15, 15:1, 15:2, 15:3, 15:4, 60, 62, and 66 may be suitable for use as a cyan coloring agent.

Colorants, as used herein, include dyes, pigments, and predispersions, among others. These colorants may be used singly, in a mixture, or as a solid solution. In various embodiments, pigments may be provided in the faun of raw pigments, treated pigments, pre-milled pigments, pigment powders, pigment presscakes, pigment masterbatches, recycled pigment, and solid or liquid pigment predispersions. As used herein, a raw pigment is a pigment particle that has had no wet treatments applied to its surface, such as to deposit various coatings on the surface. Raw pigment and treated pigment are further discussed in PCT Publication No. WO 2005/095277 and U.S. Patent Application Publication No. 20060078485, the relevant portions of which are incorporated herein by reference. In contrast, a treated pigment may have undergone wet treatment, such as to provide metal oxide coatings on the particle surfaces. Examples of metal oxide coatings include alumina, silica, and zirconia. Recycled pigment may also be used as the starting pigment particles, where recycled pigment is pigment after wet treatment of insufficient quality to be sold as coated pigment.

The coloring agent of the present invention is selected in terms of the hue angle, saturation, brightness, weather resistance, OHP transparency, and dispersibility into the toner. The coloring agent may be added in an amount of 0.5 to 20 parts by weight based on 100 parts by weight of the thermoplastic resin.

Magnetic Additive

Further, the toner of the present invention may contain a magnetic material and be used as a magnetic toner. In this case, the magnetic material may also function as a coloring agent. Examples of the magnetic material contained in a magnetic toner in the present invention include iron oxides such as magnetite, hematite, and ferrite; metals such as iron, cobalt, and nickel, or alloys of these metals with metals such as aluminum, cobalt, copper, lead, magnesium, tin, zinc, antimony, beryllium, bismuth, cadmium, calcium, manganese, selenium, titanium, tungsten, and vanadium; and mixtures thereof.

The magnetic material used in the present invention may preferably be a surface modified magnetic material. Examples of surface modifiers that may be used to hydrophobically treat magnetic material include a silane coupling agent and a titanium coupling agent.

The magnetic material used in the compounds disclosed here may have a mean particle size of 2 μm or smaller, preferably from 0.1 to 0.5 μm. The magnetic material may be included in the compound in an amount ranging from 20 to 200 parts by weight, preferably from 40 to 150 parts by weight, based on 100 parts by weight of the thermoplastic resin.

The magnetic material preferably has magnetic properties when 796 kA/m (10 k oersted) is applied such as a coercive force (Hc) of 1.59 to 23.9 kA/m (20 to 300 oersted), a saturation magnetization (as) of 50 to 200 emu/g, and a remnant magnetization (or) of 2 to 20 emu/g.

External Additives

Charge Control Agent

In certain embodiments of the present invention, a charge control agent may be included in the compounds disclosed herein. Examples of a charge control agent used to control the charge to be negative include an organometallic compound, a chelate compound, a monoazometallic compound, an acetylacetone metallic compound, a urea derivative, a metal-containing salicylic acid compound, a metal-containing naphthoic acid compound, a tertiary ammonium salt, calixarene, a silicon compound, and a non-metal carboxylic acid compound and its derivative. Although described here as an external additive, charge control agents may be used as an internal additive in some embodiments.

Examples of a charge control agent used to control the charge to be positive include nigrosine and its modified product by a fatty acid metal salt; quaternary ammonium salts such as tributylbenzylammonium-1-hydroxy-4-naph-thosulfonate and tetrabutylammonium tetrafluoroborate, and onium salts and their analogues such as a phosphonium salt, and their lake pigments, and triphenylmethane dyes and their lake pigments, of which laking agents include phosphotungstic acid, phosphomolybdic acid, phosphotungsticmolybdic acid, tannic acid, lauric acid, gallic acid, a ferricyanide, and a ferrocyanide; metal salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate. These may be used singly or in a combination of two or more. Of these, charge control agents such as nigrosins and quaternary ammonium salts may be preferable.

Some additives useful in embodiments disclosed herein may function as both a charge control agent and a flow control agent. For example, silica, titania, and alumina particles may be used to effect charge control and flow control for toner particles formed in embodiments disclosed herein.

The toner compound may include a charge control agent in an amount ranging from 0.01 to 20 parts by weight, preferably from 0.5 to 10 parts by weight, based on 100 parts by weight of the thermoplastic resin in the toner.

Auxiliary Fine Particles

In select embodiments, it is advantageous to add auxiliary fine particles to the base toner particles in order to improve the fluidity, the electrification stability, or the blocking resistance at a high temperature, etc. The auxiliary fine particles to be fixed on the surface of the base toner particles may be suitably selected for use among various inorganic or organic fine particles.

As the inorganic fine particles, various carbides such as silicon carbide, boron carbide, titanium carbide, zirconium carbide, hafnium carbide, vanadium carbide, tantalum carbide, niobium carbide, tungsten carbide, chromium carbide, molybdenum carbide and calcium carbide, various nitrides such as boron nitride, titanium nitride and zirconium nitride, various borides such as zirconium boride, various oxides such as titanium oxide, calcium oxide, magnesium oxide, zinc oxide, copper oxide, aluminum oxide, cerium oxide, silica and colloidal silica, various titanate compounds such as calcium titanate, magnesium titanate and strontium titanate, phosphate compounds such as calcium phosphate, sulfides such as molybdenum disulfide, fluorides such as magnesium fluoride and carbon fluoride, various metal soaps such as aluminum stearate, calcium stearate, zinc stearate and magnesium stearate, talc, bentonite, various carbon black and conductive carbon black, magnetite and ferrite, may, for example, be employed. As the organic fine particles, fine particles of a styrene resin, an acrylic resin, an epoxy resin or a melamine resin, may, for example, be employed.

Among such auxiliary fine particles, silica, titanium oxide, alumina, zinc oxide, various carbon black or conductive carbon black may, for example, be particularly preferably employed. Further, such auxiliary fine particles may include the above mentioned inorganic or organic fine particles, where the surface of the particles is treated by surface treatment, such as hydrophobic treatment by a treating agent such as a silane coupling agent, a titanate coupling agent, a silicone oil, a modified silicone oil, a silicone varnish, a fluorinated silane coupling agent, a fluorinated silicone oil or a coupling agent having amino groups or quaternary ammonium bases. Such treating agents may be used alone or in combination as a mixture of two or more of them.

The above auxiliary fine particles may have an average particle size of from 0.001 to 3 μm, preferably from 0.005 to 1 μm, and a plurality having different particle sizes may be used in combination. The average particle size of the auxiliary fine particles may be obtained by observation by an electron microscope.

As the above auxiliary fine particles, two or more different types of auxiliary fine particles may be used in combination. For example, surface-treated particles and non-surface-treated particles may be used in combination, or differently surface-treated particles may be used in combination. Otherwise, positively chargeable particles and negatively chargeable particles may be suitably combined for use. As a method for adding the auxiliary fine particles to the base toner particles, a method is known to add and blend them by means of a high speed stirring machine such as a Henschel mixer.

Other Additives

A number of other additives, known to those of ordinary skill in the art, may be used in embodiments of the present invention. For example, an additive may be used in order to improve various properties of the toner. Examples of such additives include metal oxides such as silicon oxide, aluminum oxide, titanium oxide, and hydrotalcite; carbon black, and fluorocarbon. Preferably, these additives may be hydrophobically treated.

A polishing agent may be used in accordance with embodiments of the present invention. Typical polishing agents include strontium titanate; metal oxides such as cerium oxide, aluminum oxide, magnesium oxide, and chromium oxide; nitrides such as silicon nitride; carbides such as silicon carbide; and metal salts such as calcium sulfate, barium sulfate, and calcium carbonate.

A lubricant may be used in accordance with embodiments of the present invention. Typically lubricants include fluororesin powders such as vinylidene fluoride and polytetrafluoroethylene; and fatty acid metal salts such as zinc stearate and calcium stearate.

Additionally, charge controlling particles include metal oxides such as tin oxide, titanium oxide, zinc oxide, silicon oxide, and aluminum oxide; and carbon black.

These additives may be used in an amount ranging from 0.1 to 10 parts by weight, preferably from 0.1 to 5 parts by weight, based on 100 parts by weight of the toner particles. These external additives may be used singly or in a combination.

Formulations

In preferred formulations, aqueous dispersions in accordance with the present invention may include a thermoplastic resin, optionally a stabilizing agent, and optionally an internal or external additive. In various embodiments, the thermoplastic resin and the stabilizing agent may be present in an amount of 45-99% by weight, based on a total weight of the dispersion Additives described above may be used in the compositions external to the dispersion particles, such as incorporated in the composition following the formation of the aqueous dispersion, or may be used in the compositions internal to the dispersion particles, such as incorporated in the compositions prior to or during the formation of the aqueous dispersion.

The amount and type of additive may depend on whether it is used as an internal or external additive. For example, when used as an internal additive, a wax may be used in an amount ranging from 0.1 to 20 parts by weight, but may be used as an external additive in an amount ranging from 0.1 to 10 parts by weight, due to the differences in surface exposure and other factors when additives are used as an internal additive.

In one embodiment, a thermoplastic resin, a stabilizing agent, if used, and optionally at least one of an internal additive are melt-kneaded along with water and a neutralizing agent, such as ammonia, potassium hydroxide, or a combination of the two to form an aqueous dispersion compound. The internal additives may be mixed with the thermoplastic resin either during or prior to the formation of the aqueous dispersion and/or extrusion. Those having ordinary skill in the art will recognize that a number of other neutralizing agents may be used, as described above. In some embodiments, an internal additive may be added after blending the thermoplastic resin and stabilizing agent, if used. In other preferred embodiments, an external additive may be added after the aqueous dispersion is formed. In addition, any other suitable additives (such as any of those discussed above) may be added to the composition prior to, during, or after the formation of the aqueous dispersion.

In another embodiment, a thermoplastic resin, such as a self-stabilizing resin, and optionally at least one internal additive are melt-kneaded along with water and a neutralizing agent, such as ammonia, potassium hydroxide, or a combination of the two to form an aqueous dispersion compound. In yet another embodiment, a thermoplastic resin, a stabilizing agent, and optionally at least one internal additive are melt-kneaded in an extruder along with water without use of a neutralizing agent to form an aqueous dispersion compound.

Any continuous melt-kneading or dispersing means known in the art may be used. In some embodiments, a kneader, a rotor-stator mixer, a BANBURY® mixer, a single-screw extruder, or a multi-screw extruder is used. A process for producing the aqueous dispersions in accordance with the present invention is not particularly limited. Any reference to use of an extruder herein is not intended to be a limitation on the present invention. One preferred process, for example, is a process comprising melt-kneading the above-mentioned components according to U.S. Pat. Nos. 5,756,659 and 6,455,636, which are herein incorporated by reference in their entirety. An alternative example in which an extruder is not required allows for the mechanical dispersion to be formed in a high shear mixer. The high shear mixer may be specifically applicable to aqueous dispersions using polyesters and some styrenic copolymers, for example. In some embodiments, an extruder, such as used for melt blending, may be coupled to a disperser, such as used for emulsification, as described in U.S. Pat. No. 6,512,024, which is incorporated herein by reference.

FIG. 1 schematically illustrates an extrusion apparatus that may be used in embodiments of the invention. An extruder 20, in certain embodiments a twin screw extruder, is coupled to a back pressure regulator, melt pump, or gear pump 30. Embodiments also provide a base reservoir 40 and an initial water reservoir 50, each of which includes a pump (not shown). Desired amounts of base and initial water are provided from the base reservoir 40 and the initial water reservoir 50, respectively. Any suitable pump may be used, but in some embodiments a pump that provides a flow of about 150 cc/min at a pressure of 240 bar is used to provide the base and the initial water to the extruder 20. In other embodiments, a liquid injection pump provides a flow of 300 cc/min at 200 bar or 600 cc/min at 133 bar. In some embodiments, the base and initial water are preheated in a preheater.

Thermoplastic resin in the form of pellets, powder or flakes is fed from the feeder 80 to an inlet 90 of the extruder 20 where the thermoplastic resin is melted or compounded. In some embodiments, the dispersing agent is added to the thermoplastic resin through and along with the thermoplastic resin and in other embodiments, the dispersing agent is provided separately to the twin screw extruder 20. The thermoplastic resin melt is then delivered from the mix and convey zone to an emulsification zone of the extruder where the initial amount of water and base from the reservoirs 40 and 50 is added through inlet 55. In some embodiments, dispersing agent (surfactant) may be added additionally or exclusively to the water stream. In some embodiments, the emulsified mixture is further diluted with additional water through inlet 95 from reservoir 60 in a dilution and cooling zone of the extruder 20. Typically, the aqueous dispersion is diluted to at least 30 weight percent water in the cooling zone. In addition, the diluted mixture may be diluted any number of times until the desired dilution level is achieved.

Advantageously, by using an extruder in certain embodiments, thermoplastic resins and stabilizing agents, if used, may be blended in a single process to form aqueous dispersions. The thermoplastic resins, or mixtures of thermoplastic resins, may also be easily adjusted using the process for forming aqueous dispersions as described above. The process of forming the aqueous dispersions disclosed herein may be solvent-free, reducing environmental concerns and cost. Additionally, additives may be concurrently homogeneously blended with the thermoplastic resins, providing additional cost and performance benefits.

Aqueous dispersions formed in accordance with embodiments of the present invention are characterized as having an average volume diameter particle size of between about 0.05 to about 10 microns. In other embodiments, the aqueous dispersion may have an average volume diameter particle size between about 0.05 to about 8.0 microns. In other embodiments, aqueous dispersions have an average volume diameter particle size of from about 0.1 to about 6.0 microns. As used herein, "average particle size" refers to the volume-mean particle size. In order to measure the particle size, laser-diffraction techniques may be employed, for example. A particle size in this description refers to the diameter of the polymer in the aqueous dispersion. For polymer particles that are not spherical, the diameter of the particle is the average of the long and short axes of the particle. Particle sizes can be measured, for example, on a Beckman-Coulter LS230 laser-diffraction particle size analyzer or other suitable device. In one embodiment, the desired particle sizes may be obtained by forming very small particles and aggregating these to the desired particle size.

The average particle size of the resulting aqueous dispersions may be controlled by a number of variables, including the chosen thermoplastic resin and stabilizing agent, if used. It has also been found that the level of neutralization of acidic groups in the selected thermoplastic resins and/or stabilizing agents may also affect average particle size, particle type, and particle size distribution. For example, for some resin systems, low neutralization levels may result in spherical particles whereas higher levels of neutralization may result in plate-like particles. Other variables that may affect particle size may include temperature, mixer speeds (e.g., screw rpm), and resin to water feed rate ratios.

After forming the aqueous dispersion, at least a portion of the water may be removed to form toner particles. In selected embodiments, substantially all of the water may be removed to form base toner particles. In one embodiment, drying of the aqueous dispersion may be accomplished by spray drying the aqueous dispersion. Other drying techniques known in the art may also be used, including fluid bed drying, vacuum drying, radiant drying, and flash drying, among others.

In addition to drying of the aqueous dispersion particles, forming toner particles from aqueous dispersions may also include the steps of washing and filtering to result in particles useful in toners according to embodiments disclosed herein. In some embodiments, the washing may be performed using a neutral or acidic wash medium, such as water or an aqueous mixture having a pH of about 4 to less 7. Wash media may also include organic solvents in embodiments disclosed herein. Washing, for example, may be used to remove surfactants and other unwanted residual components from the resulting aqueous dispersion particles. In addition, by adjustment of the pH of the wash water, modification of surface acid groups may be accomplished on the aqueous dispersion particles. For example, negatively charged carboxylate salt groups may be converted to neutral carboxylic groups once the particles have been formed.

Thus, in one embodiment, an aqueous dispersion may be formed, and shipped to another location, where the aqueous dispersion is subjected to a post-treatment process such as spray drying to form a toner powder.

In some embodiments, aqueous dispersion particles formed by the above described processes may be aggregated and/or coalesced to form toner particles. Any suitable dispersion aggregation process may be used in forming the aggregated dispersion particles. In some embodiments, the aggregating processes may include one or more of the steps of a) aggregating an emulsion containing binder, optionally one or more colorants, optionally one or more surfactants, optionally a wax, optionally a coagulant and one or more additional optional additives to form aggregates, b) subsequently coalescing or fusing the aggregates, and c) recovering, optionally washing, and optionally drying, the obtained aggregated particles.

One embodiment of an aggregation process includes forming an aqueous dispersion compound including a thermoplastic resin and 0 to 5 weight percent of a stabilizing agent, optional colorant, optional additives, and an aggregating agent in a vessel. The mixture is then stirred until homogenized and heated to a temperature of, for example, about 50° C. The mixture may be held at such temperature for a period of time to permit aggregation of the toner particles to the desired size. Once the desired size of aggregated toner particles is achieved, the pH of the mixture may be adjusted in order to inhibit further aggregation. The toner particles may be further heated to a temperature of, for example, about 90° C. and the pH lowered in order to enable the particles to coalesce and spherodize. The heater is then turned off and the reactor mixture allowed to cool to room temperature, at which point the aggregated and coalesced toner particles are recovered and optionally washed and dried.

Any aggregating agent capable of causing complexation may be used. Both alkali earth metal and transition metal salts may be used as aggregating agents. Examples of the alkali (II) salts that may be used include beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, and barium iodide. Examples of transition metal salts or anions that may be used include acetates, acetoacetates, sulfates of vanadium, niobium, tantalum, chromium, molybdenum, tungsten, manganese, iron, ruthenium, cobalt, nickel, copper, zinc, cadmium, silver or aluminum salts such as aluminum acetate, polyaluminum chloride, aluminum halides, mixtures thereof and the like.

In some embodiments, the aggregated particles may have a volume average diameter of less than 30 microns; from about 0.1 to about 15 microns in other embodiments; and from about 1 to about 10 microns in yet other embodiments. Once the aggregate particles reach the desired size, the resulting suspension may be allowed to coalesce. This may be achieved by heating to a temperature at or above the glass transition temperature of the primary thermoplastic resin used in the aqueous dispersion.

The aggregate particles may be removed from the suspension, such as by filtration, and subjected to washing/rinsing with, for example, water to remove residual aggregating agent, and drying, to obtain toner composition particles comprised of resin, wax, if used, and optional additives, such as colorants and other additives described above. In addition, the toner composition particles may be subjected to classifying, screening, and/or filtration steps to remove undesired coarse particles from the toner composition.

Applications

The toners described above may be used in cartridges, process cartridges, and image forming apparatus. For example, process cartridges using toners described herein may include photoconductors, charging units, developing units, cleaning units, and may be attached to the main body of an image forming apparatus in an attachable and detachable manner. As another example, toner cartridges may include an electrostatic image bearing member, and a developing means to form a visible image by developing with a toner a latent electrostatic image formed on the image bearing member. Image forming apparatus may include a latent electrostatic image bearing member, a latent electrostatic image forming means, a developing means for developing the electrostatic image and forming a visible image, a transferring means that transfers the visible image to a substrate medium, and a fixing means the fixes the transferred image to the substrate medium. Cartridges, process cartridges, and image forming apparatus are disclosed in, for example, U.S. Pat. Nos. 7,177,582, 7,177,570, 7,169,525, 7,166,401, 7,161,612, 6,477,348, 5,974,281, and others.

COMPARATIVE EXAMPLE 1

The desired amount of stabilizer and resin are weighed into a 300 ml pressurizable batch mixer where they are heated and then stirred using a Cowles blade. After reaching the mixing temperature of 140° C., water is pumped in at a rate of 5 ml/min while increasing the stirring rate to 1800 rpm. Upon addition of 120 ml water the sample is cooled for 30 minutes with continued stirring. At room temperature the sample is removed and its particle size measured. Thus, 50 g of polyester resin (Reichhold FineTone T382ES, acid number 21 mg KOH/g) is added to the mixer with 6.3 g of 25% w/w KOH aqueous solution to achieve about 150% neutralization on a molar basis. The mixer is heated to 140° C. while stirring, and 120 g of water is pumped in at a rate of 5 ml/min with additional stirring. The mixture is then cooled and the aqueous dispersion product mean volumetric particle size is found to be 0.16 microns.

The procedure in Comparative Example 1 was used to prepare the emulsions containing polyester resins as listed in Table 1.

TABLE 1

| Resin phase components | Stabilizer phase components | Molar Neutralization (Percent) | Vol. mean particle size (microns) |
|---|---|---|---|
| 50 g FineTone T382ES (acid number 21) | 2.1 g of 25% w/w aq. KOH solution | 50 | Not dispersed |
| 50 g FineTone T382ES (acid number 21) | 4.2 g of 25% w/w aq. KOH solution | 100 | 450 |
| 50 g FineTone T382ES (acid number 21) | 6.3 g of 25% w/w aq. KOH solution | 150 | 0.16 |

EXAMPLES

Example 1

Toner components are fed into a twin screw extruder at the rate of 45.5 g/min polyester resin (Reichhold FineTone T-382-ES, acid number 21 mg KOH/g), 6.2 g/min pigment masterbatch (40% Pigment Red 122, HOSTACOPY E02-M101, Clariant), and 4.9 g/min wax (Baker Petrolite POLYWAX 400). The components are melted at about 110° C. and forwarded to the emulsification zone, where an aqueous solution of 1.5% 2-amino-2-methyl-1-propanol is added at a rate of 27.4 g/min to partially neutralize the resin and stabilize the resulting emulsion (neutralization level of about 26% on a molar basis). The resulting mixture is diluted with additional water fed at 62 g/min and subsequently cooled below 100° C. before exiting the extruder into an open collection vessel. The resulting product had a volumetric mean particle size of 4.9 microns and a solids level of 39%. The emulsion is washed, filtered, and dried to result in a powder useful in producing toner. Microscopy shows that the pigment and wax are well-dispersed within the particles.

Example 2

Toner components are dry blended using a HENSCHEL mixer in the proportions 95% polyester resin (Reichhold FineTone T-382-ES) and 5% pigment yellow 180 (Toner Yellow HG, Clariant). The powder blend is fed to a twin screw extruder at a rate of 51 g/min along with 4 g/min POLYWAX 400 (Baker Petrolite). The components are melted at about 110° C. and forwarded to the emulsification zone where an aqueous solution of 3.3% ethanolamine is added at a rate of 26 ml/min to partially neutralize and stabilize the resulting emulsion (neutralization level of about 34% on a molar basis). The resulting mixture is diluted with additional water fed at 44 g/min and cooled below 100° C. before exiting the extruder. The resulting product had a volumetric mean particle size of 5.4 microns and a solids level of 44%.

Example 3

Polyester resin (Reichhold FINETONE T-382-ES, acid number 21 mg KOH/g) is melted at 140° C. and fed to a rotor-stator mixer at 50 g/min. A solution of 25% (w/w) KOH is fed at 2.1 g/min and blended with additional water pumped at a rate of 30 g/min and injected into the mixer to create an emulsion. The mixer speed is set at about 750 rpm. The resulting emulsion is fed to a second rotor-stator mixer (mixer speed set at about 500 rpm) where an additional 50 g/min water is added, diluting and cooling the emulsion to less than 100° C. before exiting the mixing system into an open collection vessel. The neutralization level of the acid with base is about 50% on a molar basis, which yields a volume average particle size of 0.11 microns. The emulsion has a final solids concentration of 38% based on weight.

Example 4

Polyester resin (Reichhold FINETONE T-6694, acid number 13 mg KOH/g) is melted at 140° C. and fed to a rotor-stator mixer at 50 g/min. A solution of 25% (w/w) AMP-95 is fed at 1.1 g/min, DOWFAX 2A1 (48% w/w) is fed at 1.1 g/min, and additional water at a rate of 22.5 g/min are injected into the mixer to create an emulsion. The mixer speed is set at about 750 rpm. The resulting emulsion is fed to a second rotor-stator mixer (mixer speed set at about 500 rpm) where an additional 54 g/min water is added, diluting and cooling the emulsion to less than 100° C. before exiting the mixing system into an open collection vessel. The neutralization level of the acid with base is about 27% on a molar basis, which yields a volume average particle size of 0.19 microns. The emulsion has a final solids concentration of 39% based on weight.

Example 5

Polyester resin (Reichhold FINETONE T-382-ES, acid number 21 mg KOH/g) is fed into a twin screw extruder at 47 g/min along with 4 g/min Baker-Petrolite POLYWAX 400 polyethylene wax. The polyester resin and wax are melt blended at about 110° C. and then merged in a high shear emulsification zone with an aqueous solution of 10.6% triethanolamine at a rate of 14.4 g/min to achieve about 60% neutralization on a molar basis. Downstream from the emulsification zone, additional water is added to dilute the emulsion to 40% solids. The polyester-wax emulsion is cooled and exits the extruder into an open collection vessel. The mean volume average particle size of the resulting product is 0.31 microns.

Example 6

Polyester resin (Reichhold FINETONE T-382-ES, acid number 21 mg KOH/g) is fed into a twin screw extruder at 44 g/min along with 6.3 g/min of a cyan pigment masterbatch in the same resin (40% Pigment Blue 15:3, HOSTACOPY BG-C101, Clariant). The pigment masterbatch and resin are melt blended at about 110° C. and then merged in a high shear emulsification zone where a stream of 11.3% triethanolamine is added at a rate of 13.9 g/min to achieve neutralization of about 60% on a molar basis. Downstream from the emulsification zone, additional water is added to dilute the product to 35% solids. The polyester-wax emulsion is cooled and exits the extruder into an open collection vessel. The volume average particle size of the resulting polyester-pigment emulsion was 0.19 microns.

Example 7

Polyester resin A (Reichhold FINETONE T-382-ES, acid number 21 mg KOH/g) is fed at a rate of 30 g/min and polyester resin B (Dianal DIACRON ER 535, acid number 7 mg KOH/g) is fed separately at a rate of 30 g/min into a twin screw extruder where they are melt blended at about 110° C. and forwarded into the emulsification zone. An aqueous solution of 8.8% triethanolamine is added at a rate of 16.5 g/min to partially neutralize the resin and stabilize the resulting emulsion (neutralization level about 66% on a molar basis). The resulting mixture is diluted with additional water and subsequently cooled below 100° C. before exiting the extruder into an open collection vessel. The volumetric mean particle size of the emulsion is 0.24 microns, with a final solids level of 40% based on weight.

Example 8

A toner particle is formed by first mixing 82 parts of the polyester emulsion from Example 2 with 10 parts Baker-Petrolite LX1381 wax aqueous dispersion, 8 parts carbon black aqueous dispersion, and 0.50 parts polyaluminum chloride. The mixture is allowed to aggregate for 2 hours at 48° C., and then allowed to coalesce for 4 hours at 85° C. The final median particle size by volume of the toner particles is 6.1 microns.

Example 9

A toner particle is formed by first mixing 92 parts of the polyester-pigment aqueous dispersion from Example 5 with 8 parts aqueous wax dispersion, and 0.50 parts polyaluminum chloride. The mixture is allowed to aggregate for 1 hour at 48° C., and then the pH is adjusted to 8 using sodium hydroxide. After addition of 5% DOWFAX 2A1 surfactant (by dry weight of polymer) the particles are allowed to coalesce for 6 hours at 85° C. The final median particle size by volume of the toner particles is 5.5 microns.

Advantageously, embodiments disclosed herein may allow for a broad range of polymers to be used in toner compositions. For example, complex polymer blends may be used, such that a portion of the blend includes crystalline, semi-crystalline, and/or amorphous polymers, fractions of the polymer blends may include cross-linked fractions, branched fractions, and blends of multiple polymers, such as styrene butylacrylate blended with polyester polymers, may be used. In addition, blends of polymers having different molecular weight and/or glass transition temperatures may also be used in order to adjust the properties of the resulting toners. This flexibility allows the toner manufacturer to adjust important toner resin properties such as pigment wetting, melt rheology, hot and cold offset, adhesion, blocking resistance, and fusing temperature.

Further, embodiments disclosed herein may involve a solvent-free process as aqueous dispersions of high viscosity polymers can be made. This provides both a cost and environmental benefit over prior art processes and toners. Further, polymerization is not needed, providing a monomer-free process, which is environmentally superior to other prior art processes. Further, embodiments may provide for smaller particle sizes and narrower particle size distributions than prior art processes.

Toners formed from the processes described herein may be more stable with respect to humidity. Low surfactant levels and no required sulfonation may result in a toner which is more environmentally stable with respect to generation and maintenance of triboelectric charge and additionally may allow for improved aggregation and coalescence. Further, the low to no surfactant required may reduce or eliminate the difficult and costly washing of the toner particles, an expensive process step including large amounts of wash water which is typically required to provide quality toner products. Additionally, the low acid values may also result in improved environmental stability and tribocharge properties of the resulting toners compared to prior art approaches. Further, low levels of base and relatively short times at elevated temperatures used for embodiments disclosed herein may result in reduced hydrolysis or transesterification of polymers used to form the toner particles.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A compound comprising:

an aqueous dispersion, the dispersion comprising water and:

(A) at least one thermoplastic resin; and (B) 0 to 5 weight percent of a stabilizing agent, based on the total weight of (A) and (B);

(C) at least one of an internal additive and an external additive; and (D) a neutralizing agent, wherein the neutralizing agent is present in an amount sufficient to neutralize less than 90% on a molar basis of any acid groups in components (A) and (B) and wherein the neutralizing agent is selected from the group consisting of primary amines, secondary amines, tertiary amines, or combinations of two or more of thereof, wherein the primary amines are selected from the group consisting of monoethanolamine, monomethylamine, monoethylamine, mono-n-propylamine, N-methanol amine, monoisopropanolamine, 2-amino-2-methyl-1-propanol, and tris(hydroxymethyl)-aminomethane, the secondary amines are selected from the group consisting of diisopropanolamine, diethanolamine, dimethylamine, diethylamine, and N-aminoethylethanolamine, and the tertiary amines are selected from the group consisting of triethanolamine, triisopropanolamine, N, N-dimethylethanolamine, trimethylamine, triethylamine, dimethyl-n propylamine, N-methyldiethanolamine, N,N-dimethyl propanolamine, and N,N,N'N'-tetrakis(2-hydroxylpropyl)ethylenediamine;

wherein the dispersion comprises particles having an average volume diameter particle size from about 0.05 to about 10 microns; and wherein a combined amount of the thermoplastic resin and the stabilizing agent has an acid number of less than 25 mg KOH/g.

2. The compound of claim 1, wherein the internal additive comprises at least one of a wax, a colorant, a charge control agent, and a magnetic additive.

3. The compound of claim 2, wherein the colorant comprises at least one pigment.

4. The compound of claim 3, wherein the pigment comprises at least one of a raw pigment, a treated pigment, a pre-milled pigment, a pigment powder, a pigment presscake, a pigment masterbatch, a recycled pigment, and a solid or liquid pigment predispersion.

5. The compound of claim 1, wherein the external additive comprises at least one of a charge control agent, an auxiliary fine particle, a polishing agent, a lubricant, and a wax.

6. The compound of claim 1, wherein the thermoplastic resin is at least one selected from the group consisting of homopolymers, copolymers, and elastomers of an alpha-olefin, copolymers and elastomers of an alpha-olefin with a conjugated or non-conjugated diene, ethylene-vinyl compound copolymers, styrenic copolymers, styrene block copolymers and elastomers, polyvinyl compounds, polymethyl acrylate, and polymethyl methacrylate, polyamides, thermoplastic polyesters, polyethylene terephthalate, polybutylene terephthalate, polycarbonate, and polyphenylene oxide.

7. The compound of claim 1, wherein the thermoplastic resin is at least one of polyesters, styrene copolymers, ethylene-propylene copolymers, and dicyclopentadiene polymers.

8. The compound of claim 1, wherein the thermoplastic resin comprises an ethylene-based homopolymer, copolymer, interpolymer, or multi-block interpolymer, a propylene-based homopolymer, copolymer, interpolymer, or multi-block interpolymer, or combinations thereof.

9. The compound of claim 1, wherein the thermoplastic resin comprises at least one polyester formed by reacting an aliphatic diol with an alkanedioic acid.

10. The compound of claim 9, wherein the aliphatic diol comprises at least one of cis-1,3-cyclohexanedimethanol, trans-1,3-cyclohexanedimethanol, cis-1,4-cycloexanediethanol, and trans-1,4-cyclohexanedimethanol.

11. The compound of claim 1, wherein components A and B together are present in an amount of 45-99% by weight, based on a total weight of the dispersion.

12. A method for forming a toner, the method comprising:

forming a compound, the compound comprising:

an aqueous dispersion, the aqueous dispersion comprising water and:

(A) a thermoplastic resin; and (B) 0 to 5 weight percent of a stabilizing agent, based on the total weight of (A) and (B); and (C) a neutralizing agent, wherein the neutralizing agent is present in an amount sufficient to neutralize less than 90% on a molar basis of any acid groups in components (A) and (B) and wherein the neutralizing agent is selected from the group consisting of primary amines, secondary amines, tertiary amines, and combinations of two or more thereof, wherein the primary amines are selected from the group consisting of monoethanolamine, monomethylamine, monoethylamine, mono-n-propylamine, N-methanol amine, monoisopropanolamine, 2-amino-2-methyl-1-propanol, and tris(hydroxymethyl)-aminomethane, the secondary amines are selected from the group consisting of diisopropanolamine, diethanolamine, dimethylamine, diethylamine, and N-aminoethylethanolamine, and the tertiary amines are selected from the group consisting of triethanolamine, triisopropanolamine, N, N-dimethylethanolamine, trimethylamine, triethylamine, dimethyl-n propylamine, N-methyldiethanolamine, N,N-dimethyl propanolamine, and N,N,N'N'-tetrakis(2-hydroxylpropyl)ethylenediamine;

wherein the aqueous dispersion comprises particles having an average volume diameter particle size from about 0.05 to about 2 microns; and wherein a combined amount of the thermoplastic resin and the stabilizing agent has an acid number of less than 25 mg KOH/g; and forming toner using at least a portion of the compound;

wherein the forming the compound comprises: melt kneading the thermoplastic resin and optionally an internal additive in a melt kneader to form a resin melt.

13. The method of claim 12, further comprising admixing an external additive with the aqueous dispersion.

14. The method of claim 12, wherein the method is substantially organic solvent-free.

15. The method of claim 12, further comprising aggregating the dispersion particles to form aggregate particles.

16. The method of claim 15, further comprising coalescing the aggregate particles.

17. The method of claim 16, further comprising at least one of: removing at least a portion of the water from the compound; filtering at least one of the compound, the dispersion particles, and the coalesced aggregate particles; classifying at least one of the compound, the dispersion particles, and the coalesced aggregate particles; washing at least one of the coalesced aggregate particles and the dispersion particles; and post-treating the toner particles.

18. The method of claim 12, wherein the aqueous dispersion further comprises at least one of an internal additive, and an external additive.

* * * * *